United States Patent [19]

Rossey, Sr.

[11] 4,243,119

[45] Jan. 6, 1981

[54] FOLDING BUILDING SIDE MOUNTED FIRE LADDER

[75] Inventor: Eugene Rossey, Sr., Milwaukee, Wis.

[73] Assignee: Ladder of Life, Inc., Milwaukee, Wis.

[21] Appl. No.: 34,141

[22] Filed: Apr. 27, 1979

[51] Int. Cl.[3] ..... E06C 9/12

[52] U.S. Cl. ..... 182/96; 182/160

[58] Field of Search ..... 182/96, 95, 159, 160

[56] References Cited

U.S. PATENT DOCUMENTS

| | | | |
|---|---|---|---|
| 258,186 | 5/1882 | Winters | 182/159 |
| 3,414,081 | 12/1968 | Wedvik | 182/160 |
| 4,037,686 | 7/1977 | Shull | 182/160 |

FOREIGN PATENT DOCUMENTS

| | | | |
|---|---|---|---|
| 1026107 | 4/1966 | United Kingdom | 182/96 |

*Primary Examiner*—Reinaldo P. Machado

*Attorney, Agent, or Firm*—Clarence A. O'Brien; Harvey B. Jacobson

[57] ABSTRACT

A pair of upstanding elongated side rails are provided and interconnected by a plurality of vertically spaced horizontal elongated rungs extending therebetween and pivotally attached at their opposite ends to the corresponding side rails whereby a foldable parallelogram construction is provided. One of the side rails includes anchor structure for anchoring the one side rail in an upright position relative to a suitable support structure and the assembly is foldable between a first closed position with the side rails closely adjacent each other and the rungs generally paralleling the side rails and a second open position with the side rails spaced apart and the rungs generally horizontally disposed. The other side rail is swingable outwardly and downwardly relative to the one side rail upon folding of the assembly from the closed position toward the open position thereof and elongated collapsible inclined brace structure is connected between an upper portion of the one side rail and a lower portion of the other side rail and limits folding of the construction from the closed position toward the aforementioned open position. A first of the side rails defines a channel member opening toward the second side rail and in which the rungs and at least the adjacent portions of the second side rail are receivable when the assembly is folded to its closed position.

4 Claims, 6 Drawing Figures

Fig. 1
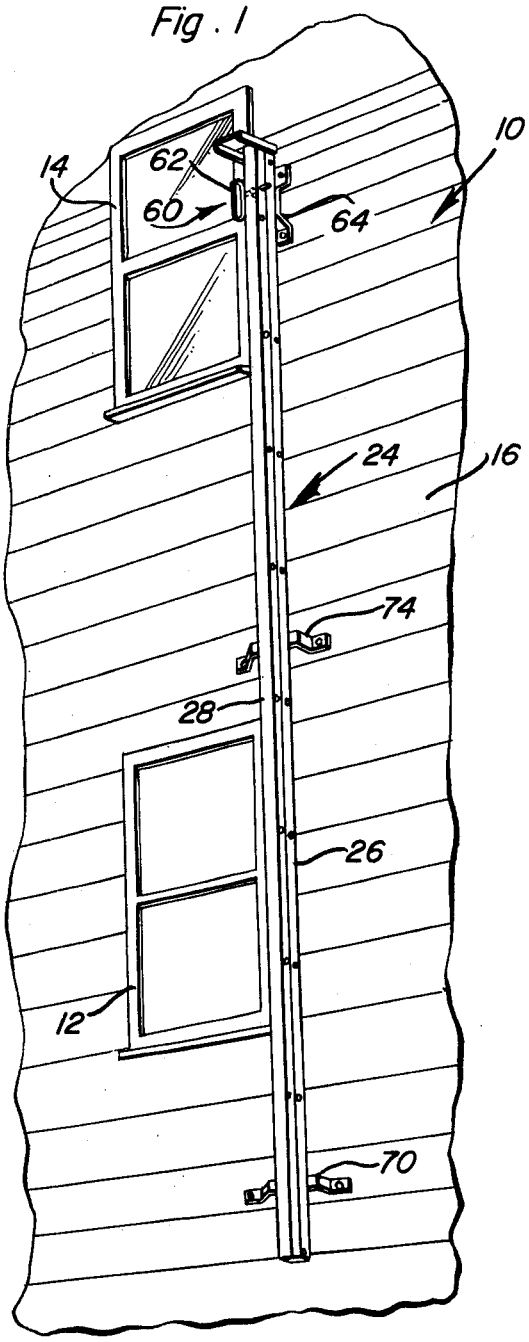
Fig. 2
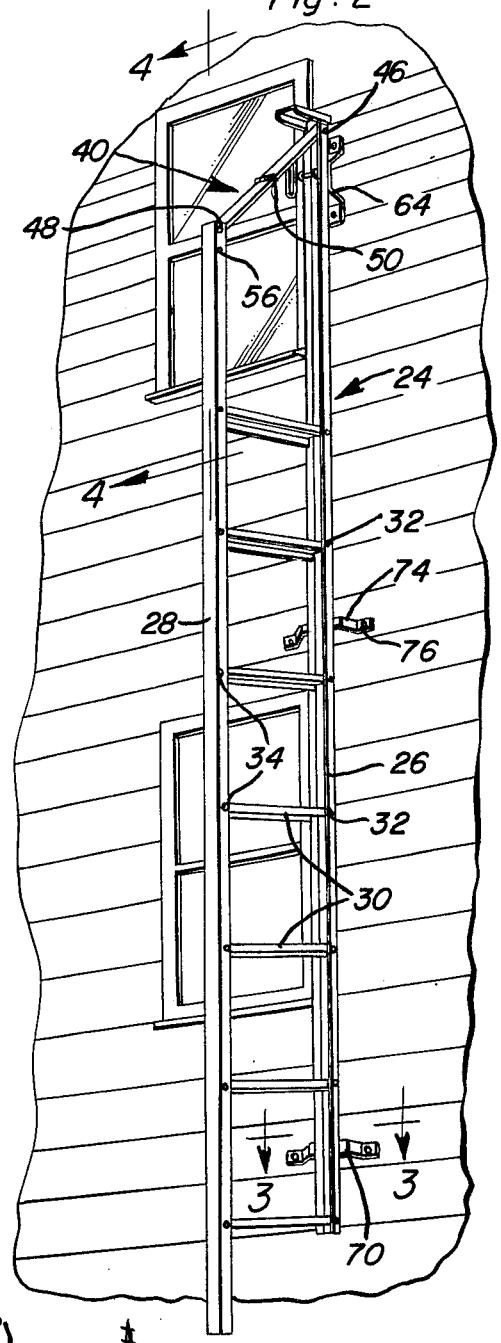
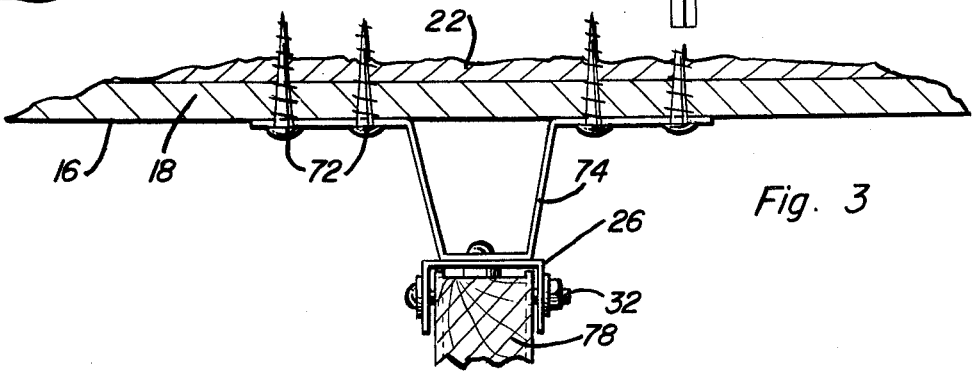
Fig. 3

FOLDING BUILDING SIDE MOUNTED FIRE LADDER

BACKGROUND OF THE INVENTION

Various forms of structures have been heretofore provided to enable escape from the upper floors of a building in the case of a fire or other emergency preventing normal exit from the building. Some of these previous structures have included collapsible and/or foldable ladder assemblies and some of these ladder structures are constructed in a manner whereby they may be stored in a relatively inobtrusive manner when not in use. However, a need exists for a foldable fire ladder and escapes for attachment to the exterior side of a building and which may be stored in an unobstrusive collapsed or folded state when not in use and yet which may be readily unfolded to an open operative condition and provide a sturdy support structure which may be used by the occupants of a building for emergency exit therefrom.

Examples of various forms of fire ladders and escapes as well as other similar structures including some of the general structural and operational features of the instant invention are disclosed in U.S. Pat. Nos. 48,333, 295,127, 2,492,511, 3,025,923, 3,314,081, 3,756,347 and 4,037,686.

BRIEF DESCRIPTION OF THE INVENTION

The foldable ladder of the instant invention includes a pair of vertical spaced apart side rails interconnected by means of a plurality of horizontal and vertically spaced rungs extending between and pivotally attached at their opposite ends to the corresponding side rails. In this manner, a foldable ladder of the parallelogram type is provided and may be readily swung between an open ladder defining position and a closed position with the side rails closely adjacent each other and the rungs of the ladder generally paralleling the side rails. Further, one of the side rails comprises a channel member into the rungs and at least the adjacent portions of the other side rail may be received when the ladder is collapsed to its closed position. In addition, an articulated inclined brace is connected between a first side rail of the ladder adapted to be anchored relative to the side of a building and a lower portion of the other side rail. The inclined brace defines a limit of unfolding of the ladder from its closed position to its open operative ladder defining position. Further, when the ladder is in its closed position, the external appearance thereof is not unlike that of a convention downspout whereby the ladder construction may be supported from the side of the adjacent building in an unobstrusive manner.

The main object of this invention is to provide a foldable ladder which may be used for the purpose of emergency exit from the upper floors of a building.

Another object of this invention is to provide a fire ladder of the foldable type whereby it may be stored in a folded position when not needed preventing the use of the ladder for ascending the side of the associated building and yet which may be readily unfolded to an operative condition for use in emergency exit from the associated building.

Still another important object of this invention is to provide a ladder in accordance with the preceding objects and constructed in a manner whereby the ladder may be releasably locked in a folded inoperative position and released for unfolding to the operative position from an upper portion of the ladder.

Still another very important object of this invention is to provide a fire ladder which will be capable of supporting considerable loads therefrom.

A final object of this invention to be specifically enumerated herein is to provide a fire ladder in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of the side of a conventional residential building with the fire ladder of the instant invention mounted on the side of the building and in a closed inoperative position;

FIG. 2 is a fragmentary perspective view similar to FIG. 1 but with the fire ladder in an unfolded open operative position;

FIG. 3 is an enlarged fragmentary horizontal sectional view taken substantially upon the plane indicated by the section line 3—3 of FIG. 2;

DETAILED DESCRIPTION OF THE INVENTION

Figure 4:
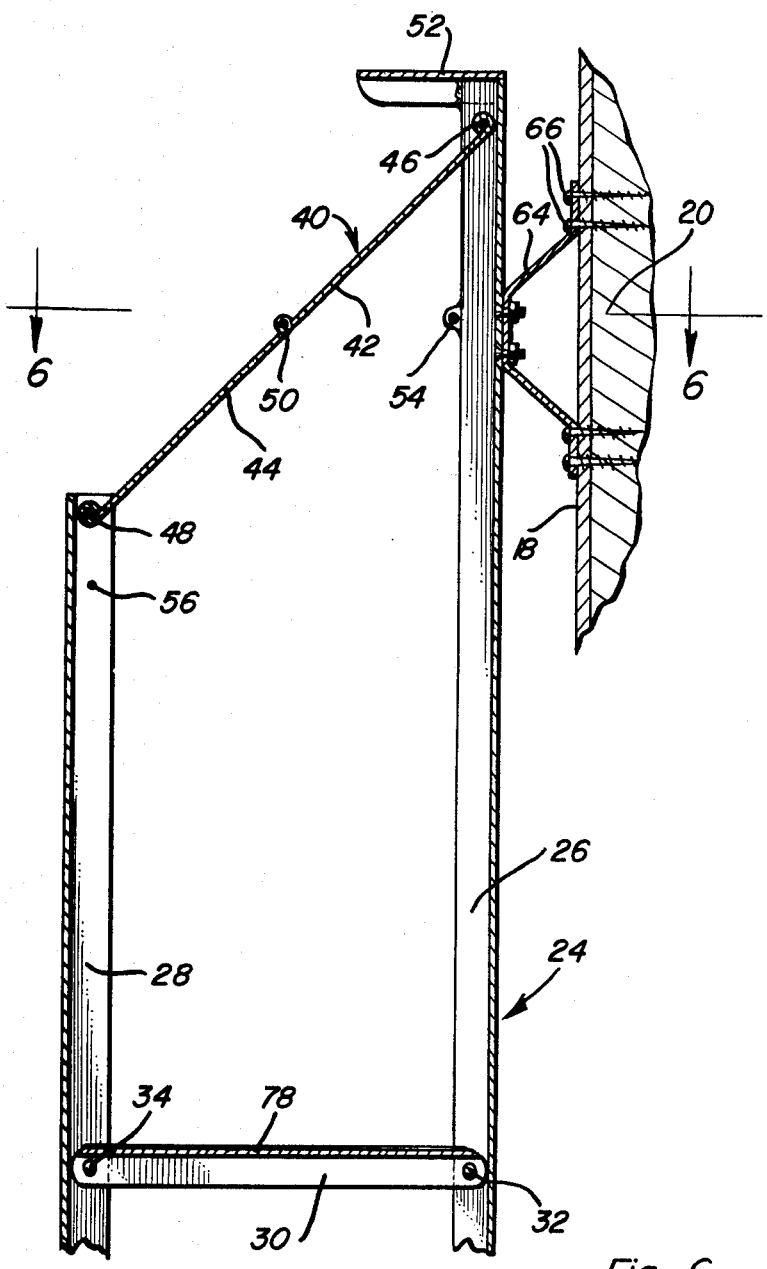
FIG. 4 is a fragmentary enlarged vertical sectional view taken substantially upon the plane indicated by the section line 4—4 of FIG. 2.

Referring now more specifically to the drawings, the numeral 10 generally designates the conventional form of domestic building including a first floor window construction 12 and a second floor window construction 14 spaced above the window construction 12.

The building 10 includes a side wall 16 in which the window constructions 12 and 14 are mounted and the wall 16 includes an exterior covering layer 18 as well as upper and lower reinforcing members 20 and 22.

The foldable ladder of the instant invention is referred to in general by the reference numeral 24 and includes first and second wide and narrow channel member side rails 26 and 28 as well as a plurality of rung defining channel members 30 extending between and pivotally connected at their opposite ends to the corresponding side rails 26 and 28. The rungs 30 are pivotally anchored at their opposite ends to the side rails 26 and 28 by means of pivot fasteners 32 and 34 and the assemblage comprising the side rails 26 and 28 and the rungs 30 defines a parallelogram structure which may be swung between the folded closed position illustrated in FIG. 1 and the unfolded open position illustrated in FIG. 2. In the open position illustrated in FIG. 2, the side rails 26 and 28 are spaced horizontally apart and the rungs 30 are horizontally disposed and spaced vertically along the ladder 24. The side rails 26 and 28 are of generally the same length, but when the ladder 24 is in the open position illustrated in FIG. 2 of the drawings, the side rail 28 is disposed somewhat lower than the side rail 26.

An inclined articulated brace referred in general by the reference numeral 40 and including a pair of elongated strap members 42 and 44 is secured between the upper ends of the side rails 26 and 28. A first end of the strap member 42 is pivotally anchored within the upper end of the side rail 26 by means of a pivot fastener 46 and a first end of the strap member 44 is pivotally anchored within the upper end of the side rail 28 by means of a pivot fastener 48. The second ends of the strap members 42 and 44 are pivotally joined together by means of a pivot fastener 50. Accordingly, the brace 40 comprises a foldable articulated tension brace secured between the upper ends of the side rails 26 and 28.

As hereinbefore set forth, the side rail 26 is wider than the side rail 28 and when the side rail 28 is swung upwardly and inwardly toward the side rail 26 in order that the ladder 24 may be folded to its closed position illustrated in FIG. 1. The rungs 30 are fully received within the side rail 26 and the adjacent portions of the side rail 28 are also received, snugly, within the side rail 26. Also, it will be noted that the brace 40 may be folded as the side rail 28 is swung upwardly and inwardly toward the side rail 26 and that the brace 40 is therefore also fully received within the confines of the side rails 26 and 28 when the ladder 24 is in its closed position illustrated in FIG. 1. Further, the brace 40 may take many different forms. For example, the brace 40 could be in the form of a collapsible flexible tension cable or strap. Also, the brace could be in the form of a collapsible telescopic tension member.

The upper end of the side rail 26 includes a horizontally outwardly projecting flange or cover 52 beneath which the upper end of the side rail 28 is received when the ladder 24 is swung to the closed position thereof illustrated in FIG. 1 and the side rail 26 includes opposite side apertured ears 54 with which apertures 56 formed in the opposite side flanges of the channel members defining the side rail 28 are registrable. A locking pin assembly referred to in general by the reference numeral 60 and including a handle 62 is provided and may be passed through the aligned apertures 56 and the apertured ears 54 in order to lock the side rail 28 in the closed position thereof illustrated in FIG. 1. Of course, the locking pin 60 is disposed adjacent the upper window assembly 14 for removal by persons attempting to exit the building 10 through the upper window assembly 14.

The upper end of the ladder 24 includes a vertically disposed mounting bracket 64 supported from the side rail 26 and secured to the wall 16 by means of suitable fasteners 66 penetrating the reinforcing member 20. The bracket 64 is V-shaped in configuration, opens horizontally outwardly of the side of the rail 26 remote from the rail 28 and is disposed in a vertical plane. Also, the lower end of the ladder includes a similar horizontally disposed V-shaped mounting bracket 70 supported therefrom and which is also secured to the wall 16 by fasteners 72 corresponding to the fasteners 66 and penetrating the rear portion member 22. Further, a vertical mid-portion of the side rail 26 is provided with yet another horizontally disposed V-shaped mounting bracket 74 supported therefrom and anchored to the wall 16 by suitable fasteners 76 penetrating a reinforcing member (not shown) corresponding to the reinforcing member 22.

The upper surfaces of the channel-shaped downwardly opening rungs 30 are covered with a non-slip coating 78 and the side rails 26 and 28, the rungs 30 and the brace 40 may be constructed of any suitable weather resistant material such as aluminum.

Figure 5:
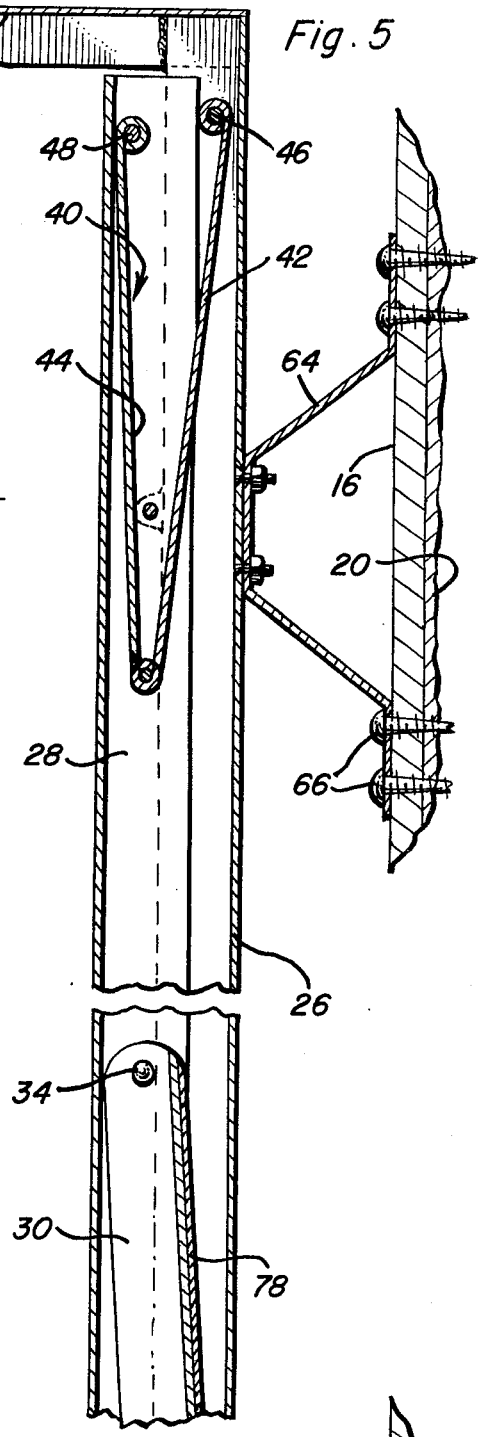
FIG. 5 is a fragmentary vertical sectional view similar to FIG. 4 but on somewhat of an enlarged scale and with the fire ladder in a closed inoperative position.
Figure 6:
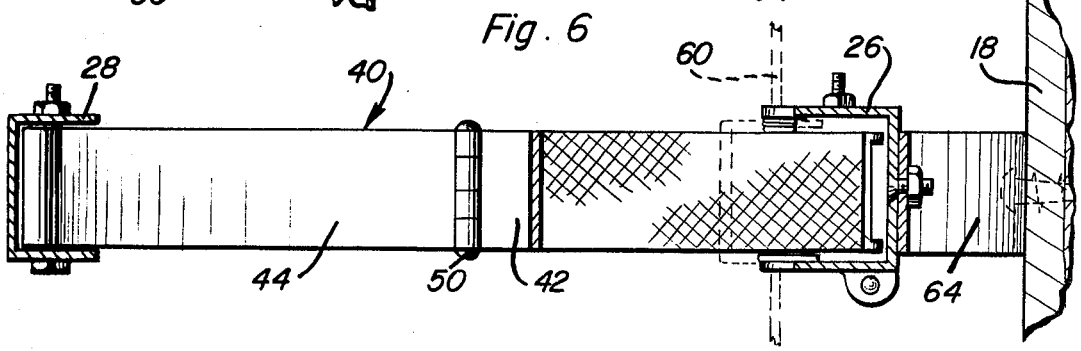
FIG. 6 is an enlarged fragmentary horizontal sectional view taken substantially upon the plane indicated by the section line 6—6 of FIG. 5.

It will be noted that the locking pin 60 may be removed by a person attempting to exit the upper window assembly 14. Once the pin 60 has been removed slight pressure on the side rail 28 will cause the side rail 28 and the rungs 30 to swing downwardly and outwardly from the positions thereof illustrated in FIG. 5 in close nested relation within the channel member 26 toward the open positions thereof illustrated in FIG. 2. Of course, the brace 40 limits downward and outward swinging movement of the side rail 28 and the rungs 30 to their open positions. Also, the brace 40 supports approximately one-half of the load supported from the rungs 30 of the ladder 24 from the upper end of the side rail 26. Thus, the entire ladder 24 is supported from the brackets 64, 70 and 74. For this reason, the fasteners 66 and 72 which secure the brackets to the wall 16 penetrate the reinforcing members disposed behind the outer covering 18 of the wall.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A foldable ladder for ascending and descending to and from an elevated level, said ladder including a pair of upstanding elongated channel-shaped side rails opening laterally outwardly toward each other and a plurality of vertically spaced horizontal elongated rungs extending between and pivotally attached at their opposite ends to and within the corresponding side rails and with said side rails and rungs defining a foldable parallelogram construction, a plurality of laterally outstanding anchor brackets carried by and spaced along one of said side rails for anchoring said one side rail in upright horizontally spaced position relative to a suitable upstanding support structure, said ladder being foldable between a first closed position with said side rails closely adjacent each other and said rungs generally paralleling said side rails and a second open position with said side rails spaced apart and said rungs generally horizontally disposed, the other side rail being swingable outwardly and downwardly relative to said one side rail upon folding of said ladder from said closed position toward said open position, and elongated collapsible inclined bracing means connected at its upper end to a predetermined portion of said one side rail at its lower end to a lower portion of said other side rail, said collapsible inclined bracing means defining a tension member brace defining the limit of outward and downward swinging movement of said other side rail from said one side rail during folding of said ladder from said closed position toward said open position, said collapsible inclined bracing means comprising an elongated articulated brace member including a pair of opposite end elongated brace member sections pivotally joined together at adjacent ends and to the upper end portions of said one and other side rails at their remote ends, said one side rail being of a greater inside transverse dimension than the outside transverse dimension of said other side rail and laterally receiving said other side rail, said bracing means and said rungs therein when said ladder is folded, the upper end of said one side rail projecting upwardly above the other side rail when said ladder is folded and including a downwardly opening laterally outwardly projecting inverted channel-shaped cover which overlies the upper ends of said one and other side rails when said ladder is folded, said anchor brackets including horizontally disposed V-shaped upper and lower brackets opening horizontally away from the side of said one side rail remote from the other side rail, the upper bracket being disposed in a vertical plane and the lower bracket being disposed in a horizontal plane.

2. The combination of claim 1 including lock structure operatively associated with said side rails and releasably locking said side rails in closely adjacent positions with said ladder folded to a closed position and against holding of said ladder toward said open position.

3. The combination of claim 2 wherein said lock structure is operatively connected between upper end portions of said side rails.

4. The combination of claim 3 wherein said lock structure includes an elongated locking pin removably passed through transverse bores formed in portions of said side rails registered with each other when said ladder is in said closed position.

* * * * *